United States Patent [19]

Bongartz et al.

[11] Patent Number: 4,484,996

[45] Date of Patent: Nov. 27, 1984

[54] CATHODE FOR USE IN ELECTROLYTIC PROCESSING SOLUTION

[75] Inventors: Roy C. Bongartz, Indiana Township, Allegheny County; Richard H. Johnston, Harrison Township, Allegheny County; James J. Odasso, Allegheny Township, Westmoreland County; Donald R. Zaremski, Cheswick, all of Pa.

[73] Assignee: Allegheny Ludlum Steel Corporation, Pittsburgh, Pa.

[21] Appl. No.: 476,185

[22] Filed: Mar. 17, 1983

[51] Int. Cl.[3] ..... C25D 17/00

[52] U.S. Cl. ..... 204/206; 204/286; 204/290 R

[58] Field of Search ..... 204/286, 290 R, 206–211, 204/141.5; 428/653, 677

[56] References Cited

U.S. PATENT DOCUMENTS

| | | | |
|---|---|---|---|
| 2,718,690 | 9/1955 | Ulam | 428/677 X |
| 3,352,005 | 11/1967 | Avellone | 428/653 X |

FOREIGN PATENT DOCUMENTS

| | | | |
|---|---|---|---|
| 46-23127 | 7/1971 | Japan | 204/206 |
| 57-43997 | 3/1982 | Japan | 204/293 |
| 57-70296 | 4/1982 | Japan | 204/290 R |
| 479896 | 2/1938 | United Kingdom | 204/206 |
| 1006396 | 9/1965 | United Kingdom | 204/290 R |
| 1539341 | 1/1979 | United Kingdom | 204/207 |

*Primary Examiner*—John F. Niebling

*Attorney, Agent, or Firm*—Patrick J. Viccaro

[57] ABSTRACT

A cathode adapted for use in electrochemical processing for surface treatment of metal products in an electrolytic bath; the cathode is constructed from a core of copper or aluminum or combinations thereof, which core is clad with stainless steel. This cathode construction provides high electrical conductivity with a relatively low cost and lightweight cathode construction.

5 Claims, 4 Drawing Figures

CATHODE FOR USE IN ELECTROLYTIC PROCESSING SOLUTION

In the manufacture of stainless steel strip, incident to both the hot and cold rolling thereof, it is conventional practice to anneal the strip in what is termed a continuous annealing furnace. The strip which is wound from a coil is passed continuously through the annealing furnace for heat treatment. Annealing in this manner is conducted on hot-rolled product prior to the initial cold rolling, incident to cold rolling to facilitate further cold rolling and for stress relief. During annealing a layer of oxide scale forms on the strip resulting from the exposure to elevated temperatures under oxidizing conditions during the annealing operation. This scale must be removed prior to further cold rolling or final processing. This is accomplished conventionally by operations including electrolytic descaling followed by pickling in an acid bath at elevated temperature. By these operations the scale is removed from the surface of the stainless steel to permit further processing, as by further cold rolling. Electrolytic descaling is effected by continuously passing the strip through a bath of an electrolyte, such as sodium sulfate, wherein the strip is made the anode and is passed adjacent to a series of electrodes which are made the cathode. In this manner, the scale is electrolytically removed from the surface of the stainless steel strip during passage through the bath and adjacent to the cathodes. Within the bath, for more efficient scale removal, the strip may first be made the anode and thereafter made the cathode and passed between a series of anodes and then again made the anode and passed adjacent a series of cathodes prior to emerging from the electrolytic bath. This reversal of polarity within the electrolytic bath facilitates scale removal. Conventionally, after emerging from the electrolytic treating bath the strip enters an acid pickling tank.

Conventionally, cathodes used in electrolytic descaling operations are of lead construction. It has been found, however, with cathodes of this type that if greater current flow is desired to facilitate descaling relatively high resistance is obtained. Increasing the cross-sectional area of the cathode would improve the conductivity but this would unacceptably increase the weight and cost of the cathode. Conventional cathodes of this type are constructed either totally of lead or of a steel core coated with lead.

It is accordingly a primary object of the present invention to provide a cathode, particularly adapted for use in electrolytic descaling operations, that provides high electrical conductivity with a relatively low cost and lightweight cathode construction.

A more specific object of the invention is to provide a cathode having high electrical conductivity at relatively low cost and lightweight construction, by constructing the cathode with a core of aluminum, copper or combinations thereof clad with stainless steel.

These and other objects of the invention as well as a more detailed understanding thereof may be obtained from the following description, specific examples and drawings, in which.

Broadly, in accordance with the present invention, the cathode thereof is made from a core of aluminum, copper or a combination thereof. The core is clad with stainless steel. During use, means are provided for connecting the cathode to a negative source of electrical potential. Preferably, the core is a metal sheet and the cladding is a stainless steel sheet which is bonded to opposite surfaces of the metal sheet of the cathode core. Exposed edges of the metal sheet comprising the core and abutting the stainless steel sheet are sealed by the use of a nonconducting sealant, which may be a rubberized or plastic material conventionally used for sealing purposes. Specifically, for use in a continuous electrolytic descaling apparatus for stainless steel strip, the cathode of the invention would be of a general L-shaped construction with the relatively long leg portion thereof positioned within the electrolytic descaling tank adjacent the surface of the stainless steel strip product being treated. The shorter leg portion of the cathode would be connected to the negative source of electrical potential. Generally, a cathode assembly or a series of cathode assemblies would be provided within the electrolytic descaling tank wherein a first cathode would be positioned as described above the pass line of the strip and generally parallel therewith and a second cathode would be positioned beneath the pass line of the strip and generally parallel therewith.

Figure 1:
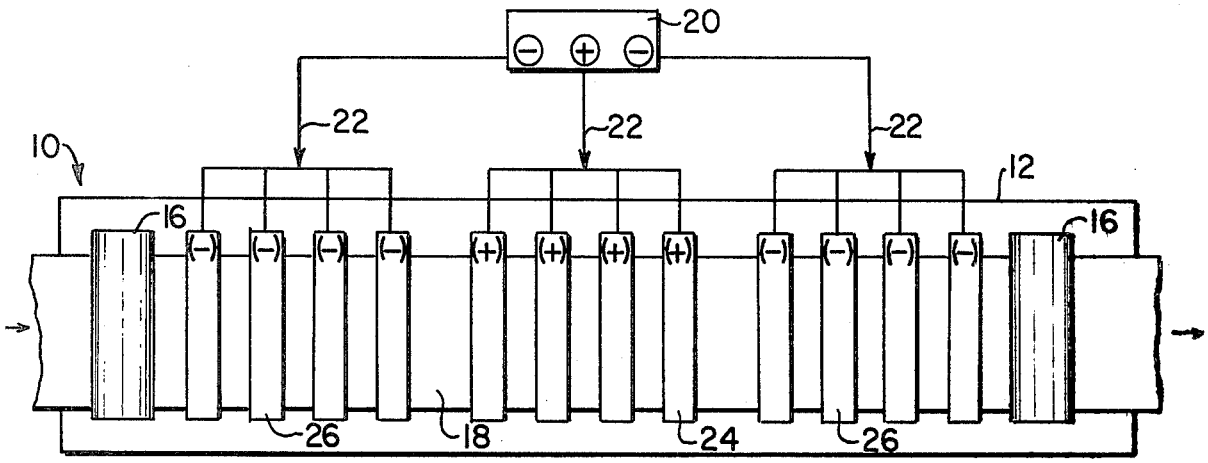
FIG. 1 is a schematic plan view of a typical electrolytic descaling apparatus with which the cathode of the invention would be used.
Figure 2:
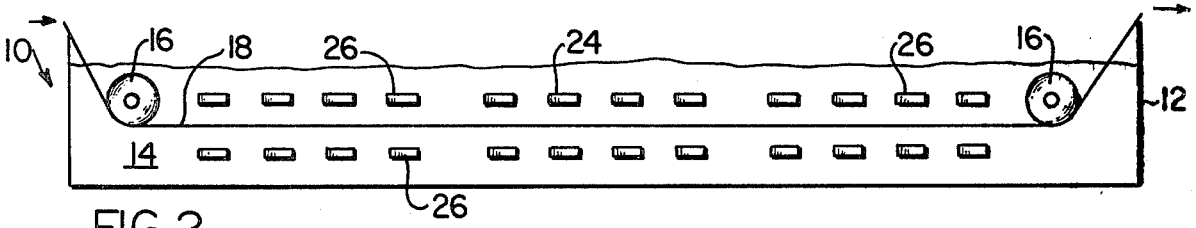
FIG. 2 is a side elevation of the apparatus of FIG. 1.

With reference to FIGS. 1 and 2 of the drawings, there is shown an electrolytic descaling apparatus, designated generally as 10, which is the type conventionally used in the electrolytic descaling of stainless steel strip. The assembly 10 has a tank 12 having therein an electrolytic bath, designated as 14, which bath may be for example sodium sulfate. Submerged rolls 16 are provided beneath the surface of the bath to guide strip 18 through the bath. A source of electrical potential, which may be rectifier 20, is electrically connected through conductors 22 to anodes 24 and cathodes 26 which are arranged in spaced-apart series along the length of the tank 12 and within electrolyte 14. During processing, the strip 18 travels through the descaling apparatus 10 in the direction of the arrows and is guided and held submerged within the electrolyte 14 by the action of submerged rolls 16.

Figure 3:
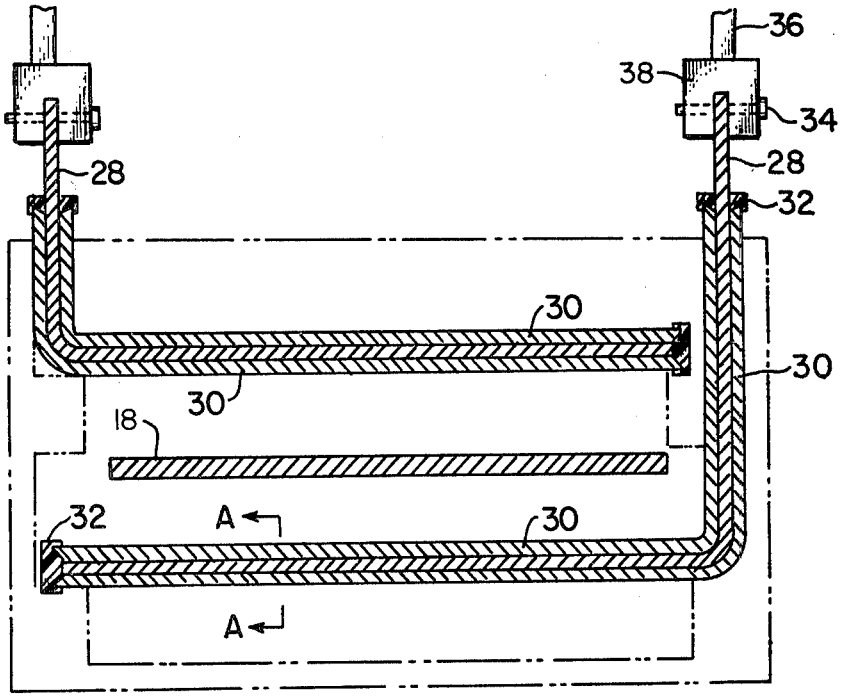
FIG. 3 is a vertical cross section of the cathode and cathode assembly of the invention.
Figure 4:
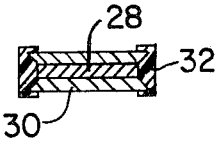
FIG. 4 is a section taken along lines A—A of FIG. 3.

FIGS. 3 and 4 show the cathode construction in accordance with the invention and would be the cathodes used and identified in FIGS. 1 and 2 as 26. The cathode as shown in FIGS. 3 and 4 comprises a sheet 28 which may be of aluminum or copper. The sheet 28 is of general L-shaped construction and has bonded thereto on opposite sides thereof sheets of stainless steel 30. The edges of the stainless steel sheet 30 are sealed to the sheet comprising the core 28 by means of a rubber or plastic sealant 32. The L-shaped cathode has a long-leg portion which is positioned within the electrolytic bath substantially parallel and in spaced-apart relation with the strip product 16 being treated. In assembly for use and as best shown in FIG. 3, one cathode is so positioned above the strip 16 and a second cathode is so positioned beneath the strip 16. The shorter-leg portion of the cathode has connected to the plate 28 constituting the core an electrode clamp 38 having a bolt 34 which fastens it to plate 28 and also having a conductor 36 which is an electrical connection with the conductors 22 of rectifier 20 as shown in FIG. 1.

By way of specific example and to demonstrate the superior performance of the cathode of the invention tests were conducted comparing conventional solid lead cathodes to cathodes constructed in accordance with FIGS. 3 and 4 of the drawings wherein the core of the cathode was aluminum and the cladding was stainless steel. The cathodes were tested in an electrolyte of a solution of 20% sodium sulfate ($Na_2SO_4$) at a temperature of 160° F. (71° C.). The strip product being treated in these tests was stainless steel of AISI Type 304. The results of these tests and the testing conditions are set forth in TABLE I.

TABLE I

CONDUCTIVITY TEST RESULTS
STAINLESS CLAD Al vs SOLID Pb CATHODES
ELECTROLYTE: 20% $Na_2SO_4$, 160° F. 971° C.)

| Work Piece | Ampere/Volt Data | | | | | |
|---|---|---|---|---|---|---|
| | | Pb Cathodes | | Stainless/Al Cathodes | | |
| (304 Strip) | Volts | Amps | Amps/Volt | Volts | Amps | Amps/Volt |
| .030" × 4" | 13.1 | 165 | 12.6 | 13.0 | 215 | 16.5 (31%) |
| .050" × 4" | 12.9 | 175 | 13.6 | 12.8 | 215 | 16.8 (23.5%) |
| .070" × 4" | 13.0 | 195 | 15.0 | 12.7 | 230 | 18.1 (20.7%) |

As may be seen from TABLE I the conductivity of the cathodes constructed in accordance with the invention were superior to the conventional solid lead cathode. Specifically, by comparing the ampere/volt relationships reported in TABLE I it may be seen that the cathodes of the invention provided an increase in current flow per unit voltage ranging 20 to 30% greater than produced with the conventional solid lead cathodes. This improvement with respect to increase in current flow will serve to facilitate the electrolytic descaling of stainless steel, and this result is achieved while maintaining a relatively low cost and lightweight cathode construction.

Although the cathode has been shown in an electrolytic descaling operation employing a sodium sulfate bath, the cathode of the invention could be used with nitric acid baths, which are used conventionally in electropickling operations, as well as carbonates, nitrate and chlorates of the alkali metals, which are used conventionally for electrochemical machining and alkaline based solutions which are used conventionally for electrolytic degreasing. Therefore, although the cathode of the invention has been described as used in the electrolytic descaling of stainless steel it may likewise find utility in other conventional electrochemical processes, which would include electropolishing, electrolytic degreasing, electrochemical machining and deburring.

What is claimed is:

1. A cathode adapted for use in electrolytic descaling of a metal product which is made anodic during treatment, said cathode comprising a core of metal sheet of at least one metal selected from the group consisting of aluminum and copper, a cladding on said core of stainless steel sheet bonded to opposite surfaces of said metal sheet, and means for connecting said cathode to a negative source of electric potential, wherein edges of said metal sheet abutting said cladding of stainless steel sheet are sealed against said cladding with a nonconducting sealant.

2. A cathode adapted for use in electrolytic descaling of a metal product which is made anodic during treatment, said cathode comprising a core of metal sheet of at least one metal selected from the group consisting of aluminum and copper, a cladding on said core of stainless steel sheet bonded to opposite surfaces of said metal sheet, and means for connecting said cathode to a negative source of electrical potential, wherein said core of metal sheet and cladding of stainless steel sheet are generally L-shaped with a relatively long leg portion adapted for positioning during said surface treatment adjacent a flat metal anode product and a relatively short leg portion having said means for connecting said cathode to said negative source of electrical potential.

3. A cathode assembly adapted for use in electrolytic descaling of a flat metal anode product in an electrolytic bath, said cathode assembly comprising a first and second cathode each comprising a core of a metal sheet of metal selected from the group consisting of aluminum and copper and a cladding of stainless steel sheet bonded to opposite surfaces of said metal sheet, each cathode being generally L-shaped and each having a relatively long leg portion adapted for positioning during said descaling in said electrolytic bath in generally parallel, spaced-apart relation with said flat metal anode product being positioned therebetween and each cathode additionally having a relatively short leg portion having means for connecting said cathode to a negative source of electrical potential.

4. The cathode assembly of claim 3 wherein each cathode has a nonconducting sealant along edges of said metal sheet abutting said stainless steel sheet.

5. The cathode assembly of claim 4 in which a plurality of said assemblies is positioned in series along a pass line of said flat metal anode product in said electrolytic bath during said descaling.

* * * * *